US011168949B2

(12) United States Patent
Carney et al.

(10) Patent No.: US 11,168,949 B2
(45) Date of Patent: Nov. 9, 2021

(54) HEAT EXCHANGERS WITH IMPROVED HEAT TRANSFER FIN INSERT

(71) Applicant: Senior UK Limited, Gwent (GB)

(72) Inventors: Thomas Carney, Batavia, IL (US); Ryan Thomas Collins, Glen Ellyn, IL (US); Brian Thomas Costello, Aurora, IL (US); Palemon Santiago Herrera, North Aurora, IL (US); John Joseph Feidt, III, South Elgin, IL (US)

(73) Assignee: Senior UK Limited, Gwent (GB)

( * ) Notice: Subject to any disclaimer, the term of this patent is extended or adjusted under 35 U.S.C. 154(b) by 0 days.

(21) Appl. No.: 16/572,229

(22) Filed: Sep. 16, 2019

(65) Prior Publication Data

US 2021/0080197 A1 Mar. 18, 2021

(51) Int. Cl.
*F28F 1/20* (2006.01)
*F28F 3/12* (2006.01)

(52) U.S. Cl.
CPC ..... *F28F 3/12* (2013.01)

(58) Field of Classification Search
CPC ..... F28F 3/12
USPC ..... 165/181
See application file for complete search history.

(56) References Cited

U.S. PATENT DOCUMENTS 7,055,341 B2 * 6/2006 Nori ..... H01L 23/427 165/80.4
2011/0232881 A1 9/2011 Downing et al.
2012/0227945 A1 * 9/2012 Taras ..... F28F 17/005 165/172
2019/0090388 A1 3/2019 Jeong

FOREIGN PATENT DOCUMENTS

FR 3075340 A1 6/2019
WO 2015041065 A1 3/2015

OTHER PUBLICATIONS

European Patent Office, Int'l Search Report and Written Opinion issued in Inter'l Application No. PCT/EP2020/075839, dated Nov. 24, 2020, 13 pgs.

* cited by examiner

*Primary Examiner* — Davis D Hwu
(74) *Attorney, Agent, or Firm* — Greenberg Traurig, LLP

(57) ABSTRACT

A substantially planar heat exchanger for regulating the temperature of objects using a fluid coolant includes a bottom plate, a top plate, a fin insert sealed therebetween and a coolant inlet and outlet. The fin insert may include a plurality of substantially flattened omega-shaped or tear-drop-shaped fins, which enhances the transfer of heat from the top and/or bottom plates into the fin insert. The omega-shaped fin inserts enhance the contact surface area between the plates and the insert to improve thermal migration therebetween. The fin insert may be constructed, for example, by forming convolutions in a sheet of metal, and compressing the convolutions laterally inwardly and vertically inwardly.

8 Claims, 7 Drawing Sheets

HEAT EXCHANGERS WITH IMPROVED HEAT TRANSFER FIN INSERT

FIELD OF THE INVENTION

The present invention generally relates to heat exchangers, and more specifically to low-profile heat exchangers with improved heat transfer characteristics for transmitting heat from heat emitting objects requiring temperature control, such as power inverters, through a coolant or other fluid flowing therethrough the heat exchanger.

BACKGROUND OF THE INVENTION

The performance of various electronic devices—such as transistors, circuit components, integrated circuits, and batteries—often directly correlates with temperature. In general, an increase in temperature causes an increase in impedance in conductors and semiconductors which, in turn, can lead to an even greater production of heat. This heat-impedance feedback loop is well known. To reduce or maintain a level of heat, devices that produce heat are commonly cooled by heat sinks, fans, or liquid cooling apparatuses. Some systems include temperature probes that monitor for overheating and, if detected, intentionally throttle down performance or shut down the device entirely to prevent permanent damage.

One type of electronic device whose operation is particularly sensitive to operating temperatures is the power inverter (e.g., a device that converts direct current (DC) to alternating current (AC)). In principle, power inverters operate by supplying a voltage to an inductor or transformer coil to drive a current through the inductor one way, reversing the voltage at that inductor or transformer coil to drive current through the inductor the opposite way, and repeating the oscillation approximately fifty to sixty times per second. The switching action is often accomplished using power transistors or solid-state relays. Modern power inverters include complex circuitry to generate approximations of sine waves, to substantially mimic the AC power supplied from the region's power grid.

The performance and product lifetime of power inverters can be affected by the operating temperatures of the power inverter—in the short term, as well as the long term. Many circuit elements present within power inverters are susceptible to heat runaway, if the temperature of the power inverter exceeds a catalyst temperature, potentially leading to permanent damage and rendering the power inverter inoperable. Even if the power inverter operates below that catalyst temperature, excessive heat may cause electrical components to wear at an increased rate, shortening the operating life of the inverter.

In addition, it is well known that power inverters do not operate at 100% efficiency, as there are inherent losses in power from circuit impedance, current switching, and from the transformer itself. While some sophisticated power inverters may operate at or near 95% maximum efficiency, the efficiency of most power inverters diminishes substantially as the temperature within the power inverter increases—sometimes going as low as 70%, or even lower, before failure occurs. Some more advanced power inverters artificially throttle the amount of power being converted based on the detected temperature, to mitigate potential damage that might otherwise occur from heat runaway. For these reasons, power inverters typically include built-in fans that serve to cool the inverter, and protection circuitry for throttling and/or emergency shutdowns.

Many electric vehicles and hybrid vehicles incorporate one or multiple power inverters to facilitate the conversion of DC power stored in batteries, to AC power for use throughout the vehicle (e.g., electric motors, regenerative braking systems, etc.). Likewise, electric and hybrid vehicles often include AC-to-DC converters, which operate in a similar fashion and whose performance also diminishes as their temperatures rise. There remains an ongoing challenge to provide electric vehicles that are robust and have comparable longevity to that of gasoline-based vehicles. It is therefore an object of the present disclosure to provide a cooling system to improve the longevity of power inverters in electric vehicles.

Because electric vehicles rely on stored battery power for propulsion (and to power the various subsystems of the vehicle), the distance across which an electric vehicle can travel on a single charge depends, in part, on the efficiency of power conversion between DC power and AC power (and vice versa). Thus, the difference in 5-10% conversion efficiency could substantially impair the performance or usefulness (e.g., range) of an electric vehicle. It is therefore another object of the present invention to provide a cooling system that maintains the temperature of a power inverter efficiently and effectively, to thereby ensure that its power conversion efficiency remains at or near its peak level.

These and other objectives and advantages of the present invention will become apparent from the following detailed written description, drawing figures, and claims.

SUMMARY OF THE INVENTION

To accomplish the aforementioned objectives, embodiments of the present invention provide for a heat exchanger with a fin insert positioned therewithin that efficiently increases the transfer of heat from a surface of the heat exchanger into a coolant flowing around the fin insert, within the sealed heat exchanger housing 101. The present invention contemplates that a sheet of metal with convolutions formed therein has arcs or "peaks" that make direct contact with a surface being heated by, for example, a power inverter. Conventional fin structures may be shaped like a bellows (e.g., like a sine wave, as shown in FIGS. 7A and 8A), having only a small amount of surface area at the peaks of the curves that touches a heated surface. As a result, such a conventional fin insert positioned within a coolant chamber may be inadequately warmed, as only a small fraction of the overall surface area of the fin insert even touches the warmed surface.

An example fin insert according to the present invention improves upon conventional fin structures by providing a structure with "omega-shaped" convolutions—that is, convolutions that are wider at one end, and narrower at the opposite end. An "omega" or teardrop-shaped fin may have its wider portion flattened to some extent, thereby providing significantly more contacting surface area between the fin insert and the heated wall. With more of the fin insert being in direct contact with the heated wall, the degree of heat transfer from the heated wall to the fin insert substantially increases. Because the fin insert increases the effective surface area being cooled by coolant flowing around and through the heat exchanger, the amount of cooling (and the effectiveness of the cooling) can be substantially improved.

The "omega-shaped" fin inserts of the present invention may be constructed, for example, by inserting shims or other objects into the fins to present portions of the fins from being compressed—and by subsequently applying an inward lateral force or series of forces (transverse to the direction of fluid flow through the fin insert) to deform the fins arounds the shims. In some embodiments, the mostly-formed fin inserts may then be pressed or sandwiched between two plates or other planar structures to flatten the tops and bottoms of the omega-shaped fins. In this manner, the amount of contacting surface area between the fin insert and the heated wall or plate substantially increases. The flattened regions contacting one or more surfaces of the heat exchanger may, in some implementations, be welded, brazed, or otherwise affixed to the inner surfaces of the heat exchanger housing elements—which can serve to further increase the contacting surface area between the fin insert and the heated wall.

In addition, some fin inserts according to the present invention may include lateral undulations, or "waves," formed therein that extend longitudinally along the length of the fins. The undulations may serve to increase turbulence of coolant flowing through the heat exchanger, which increases the transfer of heat into the coolant flowing through and around the fin inserts. These undulations may likewise be formed by like-shaped shims and/or variations in transverse pressures applied collectively to the sides of the fins during the formation process.

According to a first aspect of the present invention, there is provided a heat exchanger for regulating the temperature objects using a coolant. The heat exchanger includes a bottom plate having a first end, a second end opposite the first end, an outer surface, and an inner surface opposite the outer surface. The bottom plate includes a first coolant port proximate the first end and a second coolant port proximate the second end. The heat exchanger also includes a top plate having a first end, a second end opposite the first end, an outer surface, and an inner surface opposite the outer surface. The top plate is sealedly engaged with the bottom plate for circulation of the coolant therethrough between the first and second coolant ports. The inner surface of the bottom plate and the inner surface of the top plate collectively defines a coolant chamber. The heat exchanger further includes a substantially planar fin insert operably situated between the top and bottom plates within the coolant chamber. The fin insert includes a first end positioned proximate the first coolant port and a second end positioned proximate the second coolant port. The fin insert also includes a plurality of fins that extend longitudinally between its first and second ends. Each fin of the fin insert may include (i) a pair of angled sidewalls that converge at one end and diverge at an opposite end and (ii) a substantially flat outer wall that extends across the pair of angled sidewalls at the end where the angled sidewalls diverge. The substantially flat outer wall includes a contacting portion that is in immediate contact with the inner surface of the top or bottom plate.

In some embodiments according to the first aspect, the plurality of fins laterally, collectively undulate between the first and second end of the fin insert.

In some embodiments according to the first aspect, the pair of angled sidewalls includes a first sidewall having a first angle, and a second sidewall having a second angle, where the first and second angles are equivalent (e.g., at the same but opposite angles relative to the vertical axis, "leaning" with approximately equal and opposite slopes).

In some embodiments according to the first aspect, the contacting portion has a first length. A distance between adjacent contacting portions may be of a second length. In these embodiments, the first length may be substantially equal to the second length. In other embodiments, the first length may be greater than the second length.

In some embodiments according to the first aspect, the pair of angled sidewalls at the converging end have a first gap extending therebetween of a first width. Similarly, the pair of angled sidewalls at the diverging end have a second gap extending therebetween of a second width. The second width may be larger than the first width.

In some embodiments according to the first aspect the pair of angled sidewalls at the converging end have a first gap extending therebetween of a first width that is greater than or equal to 1 millimeter, to enable passage of debris within a coolant therebetween.

According to a second aspect of the present invention, there is provided a method of forming a heat exchanger for regulating the temperature of objects using a coolant. The method involves providing a bottom plate having a first end, a second end opposite the first end, an outer surface, and an inner surface opposite the outer surface, the bottom plate comprising a first coolant port proximate the first end and a second coolant port proximate the second end. The method also involves providing a top plate having a first end, a second end opposite the first end, an outer surface, and an inner surface opposite the outer surface. The method further involves forming, in a sheet of metal, a plurality of convolutions that each extend longitudinally between a first end and a second end of the sheet of metal. Each convolution includes vertical sidewalls and arcs connecting the vertical sidewalls. Additionally, the method involves compressing the sheet of metal in an inward lateral direction to deform the plurality of convolutions. The inward lateral compression causes the vertical sidewalls of each convolution to be angled in the lateral direction. Further, the method involves compressing the deformed sheet of metal in an inward vertical direction to substantially flatten the arcs of each convolution and form a fin insert. The method also involves positioning the fin insert in between the top and bottom plates. The method additionally involves sealedly engaging the top and bottom plates to form a coolant chamber within the inner surface of the bottom plate and the inner surface of the top plate.

In some embodiments according to the second aspect, the method further involves forming, in the sheet of metal, a series of lateral, nested undulations that each extend longitudinally between the first and second ends of the sheet of metal.

In some embodiments according to the second aspect, compressing the sheet metal in the inward lateral direction may involve (i) positioning one or more objects between the plurality of convolutions that substantially prevents the deformation of the arcs during the step of compression, (ii) applying an inward lateral force to deform the plurality of convolutions about the one or more objects, and (iii) removing the one or more objects after said application of said inward lateral force.

In some embodiments according to the second aspect, compressing the sheet metal in the inward lateral direction may involve applying one or more inward lateral forces at respective longitudinal locations along the plurality of convolutions to, in turn, cause the vertical sidewalls of each convolution to be angled in the lateral direction.

In some embodiments according to the second aspect, sealedly engaging the top and bottom plates may involve (i) applying a brazing material at an interface between the top and bottom plates and (ii) heating at least the top and bottom plates to cause the brazing material to flow between and around the interface to sealedly engage the top and bottom plates.

In some embodiments according to the second aspect, the method also involves applying a brazing material between the substantially flattened arcs of the fin insert and the inner surfaces of the top and bottom plates. The method may further involve heating at least the top and bottom plates to cause the brazing material to flow between and around the substantially flattened arcs of the fin insert and the inner surfaces of the top and bottom plates, to restrainably attach said fin insert therebetween said top and bottom plates.

The foregoing summary is illustrative only and is not intended to be in any way limiting. In addition to the illustrative aspects, embodiments, and features described above, further aspects, embodiments and features will become apparent by reference to the drawing figures, the following detailed description, and the claims.

BRIEF DESCRIPTION OF THE DRAWINGS

For a better understanding of the invention, and to show how the same may be implemented, there will now be described by way of example only, specific embodiments, methods and processes according to the present invention with reference to the accompanying drawings in which.

DETAILED DESCRIPTION OF THE EMBODIMENTS

Figure 1:
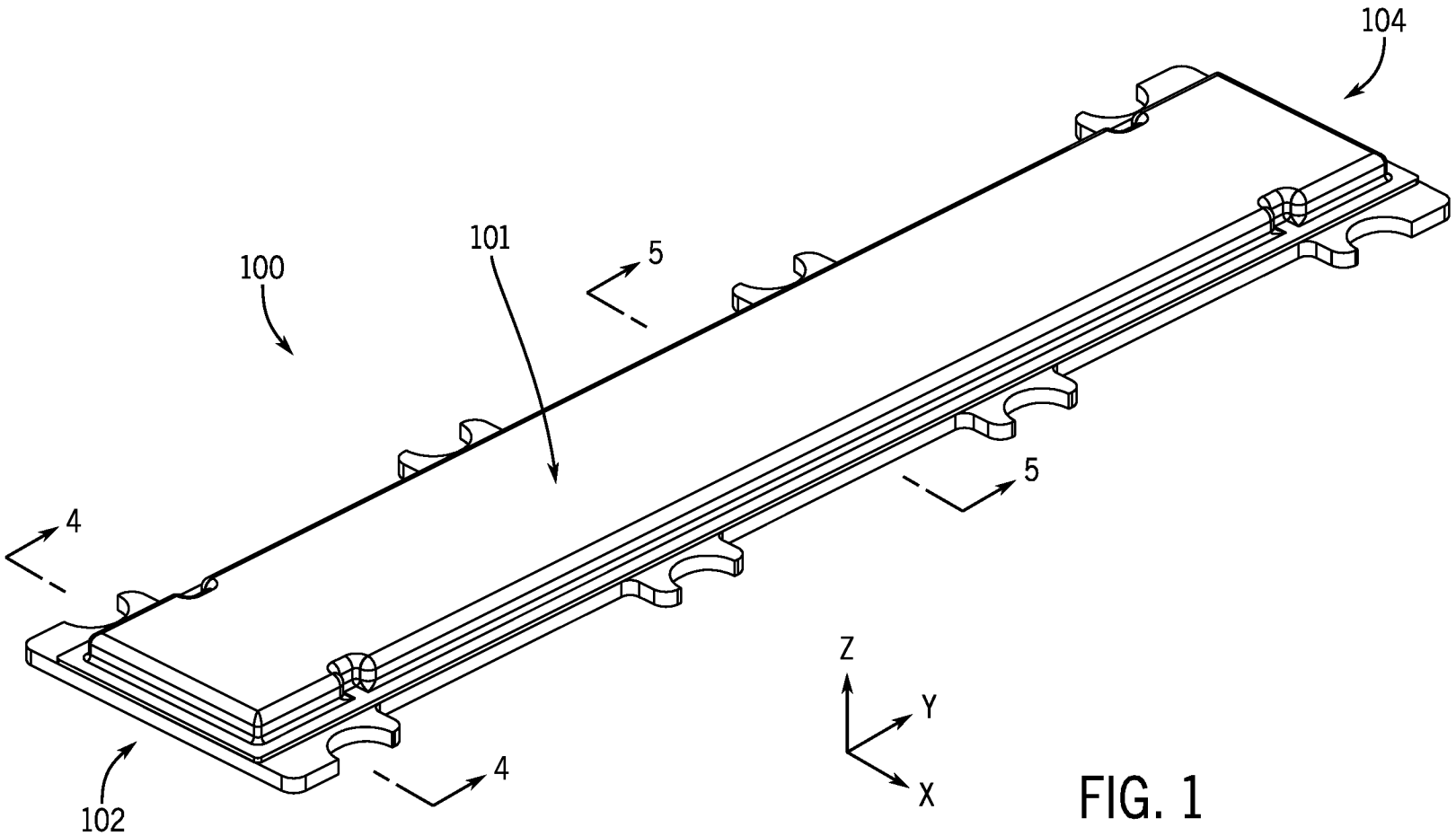
FIG. 1 is a perspective view of an example heat exchanger assembly of the present invention.

There will now be described by way of example, several specific modes of the invention as contemplated by the inventor. In the following description, numerous specific details are set forth in order to provide a thorough understanding. It will be apparent however, to one skilled in the art, that the present invention may be practiced without limitation to these specific details. In other instances, well known methods and structures have not been described in detail so as not to unnecessarily obscure the description of the invention.

As described above, embodiments of the present invention provide for a substantially flat, planar (low-profile) heat exchanger with a fin insert positioned therewithin that provides for improved heat transfer from the heated component, with the surface of the heat exchanger, and, in turn, heated into the fin insert itself, positions within the flow of a fluid coolant. The improved geometric shape and construction of the fin inserts beneficially increases the surface area of contact, between the fins themselves and the heated surface of the heat exchanger, relative to conventional fin structures. In addition, the omega-fin shape as shown and described herein is believed to advantageously enable an increased number of fins or convolutions within the same volume, further increasing the total surface area to which heat can be transferred and drawn away, using the coolant fluid. The particular aspects of the fin shapes shown, described, and contemplated in the present disclosure are described in more detail with respect to FIGS. 7A-8B.

The shape of the fins in the fin insert may be constructed to prevent or reduce the potential for possible adverse issues that may arise due to the narrowing of the coolant passageways. For example, the omega-shaped fin may have central gap between adjacent sidewalls whose distance does not fall below a threshold minimum distance (e.g., 1 millimeter, among other possible distances), which may be determined based on the size of expected particle debris to pollute or constrict the flow of the recirculated coolant during operation. In this manner, the risk of failure or diminished performance due to blockages may be significantly reduced.

In an example implementation, the heat exchanger structure shown and described herein may be placed within an electronic device assembly. For example, one or more heat exchangers may be positioned above and/or below a circuit board that performs power inversion, power conversion, and/or serves any other function. In some cases, a heat exchanger may have electronic components positioned both above and below it, such that both the upper surfaces (in the positive z-direction) and the lower surfaces (in the negative z-direction) of the heat exchanger is in contact with an electronic device or circuit for temperature regulation. The entire assembly of heat exchangers and electronics may be enclosed within a collective housing, for example, which itself may be secured within an electric vehicle. The heat exchangers shown and described herein may therefore have no particular designated "cooling" or "heating" surface, and any such designation made herein is provided for explanatory purposes only.

Various aspects of the present heat exchangers and their constituent components—including the sizes, shapes, and arrangement of plates, apertures, fins, and channels through which coolant flows—may be specifically tuned, modified, or otherwise adjusted based on the particular requirements and/or constraints of a specific application. For example, the severity of the undulations may depend on the flow rate of coolant preferably pumped through the heat exchanger. As another example, the angles of the sidewalls of the fin structure may be increased or decreased for various reasons (e.g., to increase or decrease the number of convolutions that can fit within a particular volume, to increase or decrease the total contacting surface area between the fins and the inner walls of the heat exchanger, etc.). One of ordinary skill will appreciate that such variations may be undertaken to apply the principles of the present invention to a variety of implementations, without departing from the scope of the invention.

As described herein, "coolant" may refer to any fluid—including gas, liquid, or some combination thereof—serving as a medium that draws heat from cooling blocks to cool or otherwise thermally modulate an object or objects. Although a "coolant" may be described herein as a liquid, the present application is not limited to liquid coolants. Any recitation of "liquid coolant" should be understood to encompass coolants that may not necessarily be in a liquid state, but are nonetheless fluids.

As described herein, a "cooling surface" or "heating surface" may generally refer to any surface of a heat exchanger that is configured to transfer heat between a source and a destination. For example, the flat upper surface of the heat exchanger may be in direct contact with a battery, power inverter, or other circuitry in order to regulate the temperature of that object. In that example, the flat upper surface may serve as a "cooling surface" or a "heating surface." Similarly, the lower surface underneath the heat exchanger (in the negative z-direction) may serve as a cooling or heating surface, if an object whose temperature is to be regulated is positioned proximate to the lower surface of the heat exchanger housing.

As described herein, a "fin" may refer to a single convolution, or a portion of a convolution, that forms a part of the multiple convolutions or fins of a fin insert. Each "fin" may include at least one arced or substantially flattened wall that is in direct contact with a surface of bottom plate 110 or top plate 150 of housing 101 (see FIGS. 1 and 4), and at least a segment of the two side walls extending from that arced or substantially flattened portion. It should be understood that any reference to a "fin" simply refers to a segment or convolution of fin insert 130, as shown in FIG. 2.

Although various examples of the present disclosure may refer to the transfer of heat in order to "cool" an object, it should be understood that an object may have a temperature that is below a desired operating temperature, and whose temperature could therefore be increased using fluid flowing through a heat exchanger that is comparatively warmer (e.g., to warm up a battery in the winter). Any description herein that describes a heat exchanger "cooling" an object also encompasses circumstances in which the heat exchanger can be used to "warm" an object. The scope of the present disclosure's heat exchangers is not limited only to cooling, but rather to temperature regulation generally.

The following description of FIGS. 1-8B may include orientation terminology such as "top," "bottom," "inner," "outer," "inlet end," and "outlet end," among other terms. These terms are described with respect to axes provided in each of the drawings, and may be alternated as desired. For example, by reversing the direction of fluid flow through the heat exchanger, an inlet may be used as an outlet, and an outlet may be used as an inlet. It will be appreciated that any particular terminology relating to the particular configurations or fluid flow directions are provided for explanatory purposes only, and do not limit the scope of the present disclosure.

Figure 2:
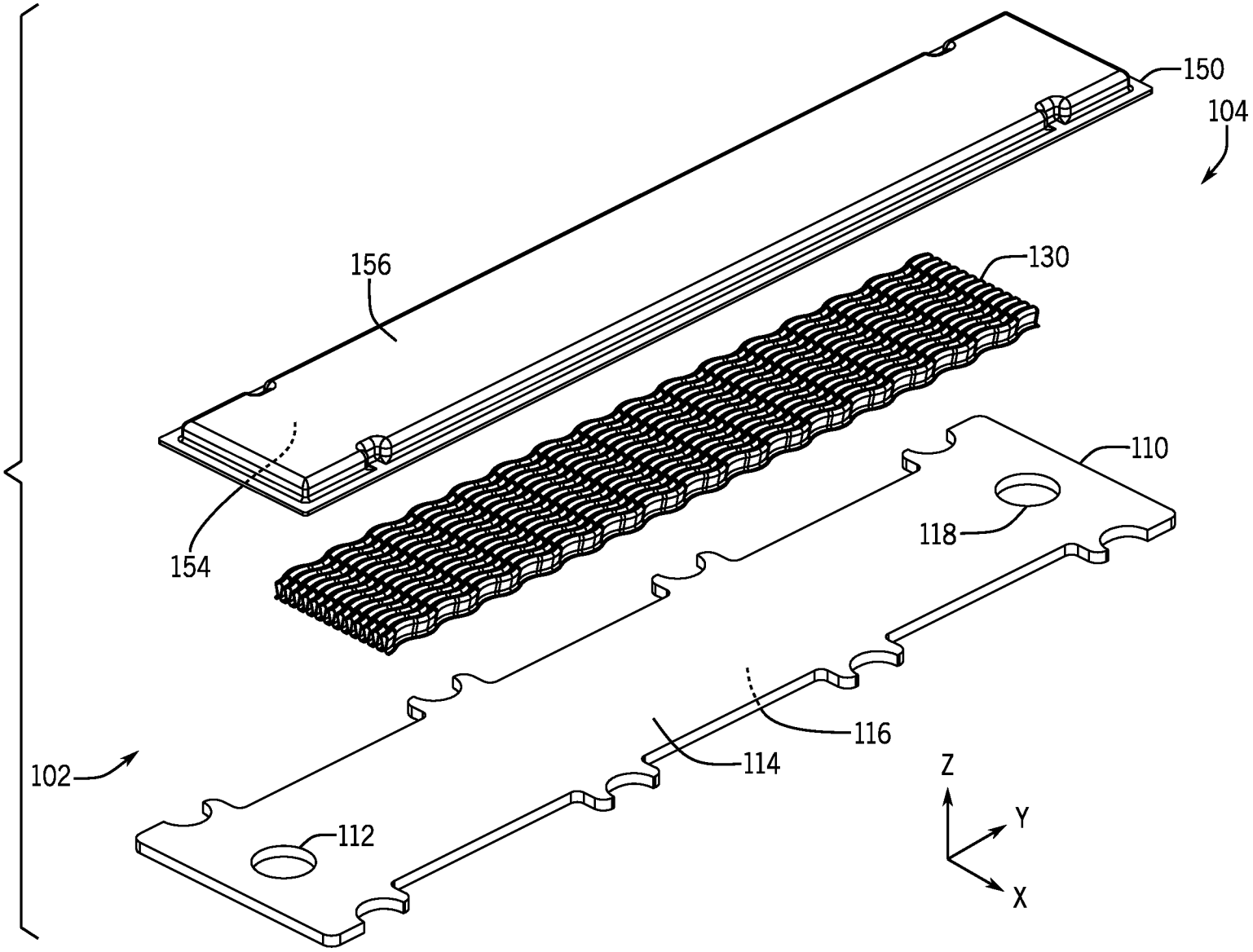
FIG. 2 is an exploded perspective view of the example heat exchanger assembly, according to the embodiment of FIG. 1.

Referring now to FIG. 1, heat exchanger 100 of the present disclosure may include inlet end 102 and an outlet end 104 at the opposite end, together with heat exchanger housing 101. For the purposes of the following detailed description, the direction of fluid flow is described as flowing from inlet end 102 toward outlet end 104 (in the negative y-direction). However, the direction of fluid flow could be reversed (in the positive y-direction), with little to no impact on the performance of heat exchanger 100. As described herein, the "lateral" direction of the fins and the direction "transverse" to the direction of fluid flow may refer to the x-direction. In addition, as described in greater detail below, and as shown in the remaining figures, top plate 150 may be positioned "above" (in the positive z-direction) bottom plate 110, as shown in FIG. 2.

The top and outer surface of heat exchanger 100, and particularly heat exchanger housing 101—the surface in the positive z-direction shown in FIG. 1, is shaped as an elongated rectangle—and may serve as a cooling surface or heated surface (e.g., the surface that comes into direct or indirect contact with an object to be cooled or otherwise have its temperature regulated). Alternatively, and/or additionally, the lower surface underneath heat exchanger 100 (the surface in the negative z-direction facing downward from the perspective shown in FIG. 1) may serve as a cooling surface or heated surface. Depending on the particular application, one or more heat exchangers 100 may be positioned at or near an object to be cooled or otherwise temperature regulated, such as a power inverter or a power converter.

FIG. 2 illustrates an exploded perspective view of heat exchanger 100, which as an assembly includes lower plate 110, upper plate 150, and fin insert 130 positioned therebetween. Lower plate 110 includes inner surface 114 (facing in the positive z-direction) and outer surface 116 (facing in the negative z-direction). Similarly, upper plate 150 includes inner surface 154 (facing in the negative z-direction) and outer surface 156 (facing in the position z-direction). A pair of apertures—inlet 112 near inlet end 102, and outlet 118 near outlet end 104—extend through lower plate 110, for integration through suitable liquid-tight couplings.

In an example implementation, coolant may be pumped or otherwise drawn through inlet 112 and into a coolant chamber defined by inner surface 114 and inner surface 154 (e.g., the space formed between lower plate 110 and upper plate 150). That coolant may flow through and around fin insert 130 the coolant chamber and toward outlet 118, through which the coolant exits heat exchanger 100. The direction of coolant flow, may also be reversed, depending upon the particular implementation.

As shown in FIG. 2, fin insert 130 is substantially flat or planar, and extends substantially along the length (in the y-directional) of the coolant chamber formed between lower plate 110 and upper plate 150, terminating before reaching coolant inlet 112, at one end and before reaching coolant outlet 118 at the other end.

Additionally, as shown in FIG. 2, lower plate 110 may include one or more apertures, cutouts, wings, flanges, bores, bosses, and/or other features formed therewithin. Fasteners may extend through these features of lower plate 110 to rigidly affix heat exchanger 100 within a system, assembly, or in close proximity to one or more objects to be cooled or heated.

Figure 3:
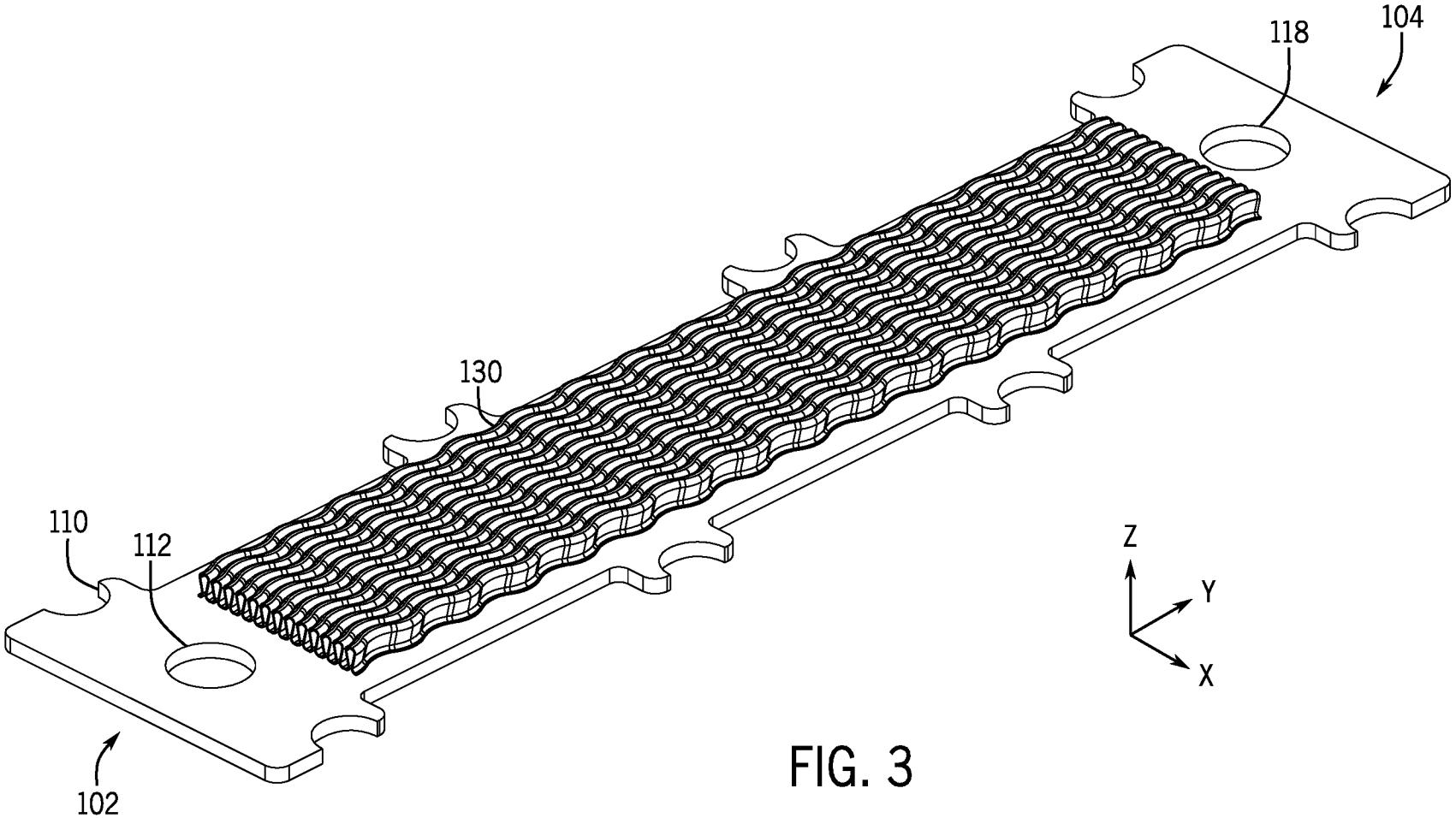
FIG. 3 is a perspective view of the bottom plate of the heat exchanger housing, and of the fin insert of the example heat exchanger assembly, according to the embodiment of FIG. 1.

FIG. 3 depicts a perspective view of bottom plate 110 and fin insert 130 of heat exchanger 100, illustrating the relative size and arrangement of fin insert 130 with respect to bottom plate 110. As shown in FIG. 3, fin insert 130 extends substantially between inlet 112 and outlet 118, without covering either, and substantially laterally (in the x-direction) across the width of lower plate 110. Preferably, fin insert 130 serves to substantially increase the heat transfer surface area that coolant comes in contact with as it flows through heat exchanger 100.

Figure 4:
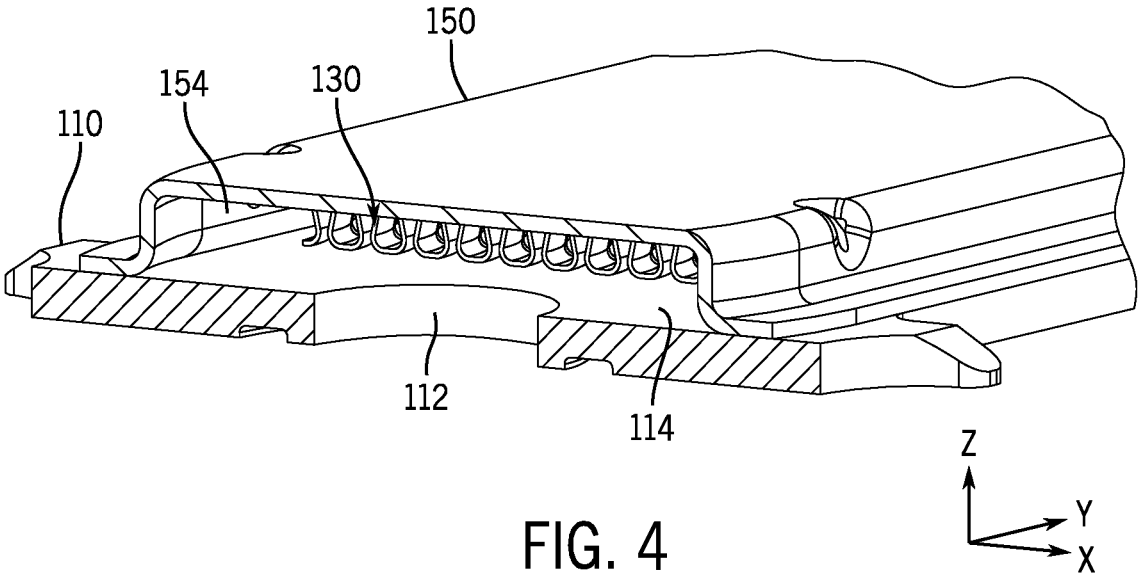
FIG. 4 is a perspective cross-sectional view of the example heat exchanger assembly, taken along lines 4-4 as shown in FIG. 1 and looking in the direction of the arrows, showing the coolant inlet and the fin insert positioned behind the inlet, between the bottom and top plates of the heat exchanger assembly housing.
Figure 5:
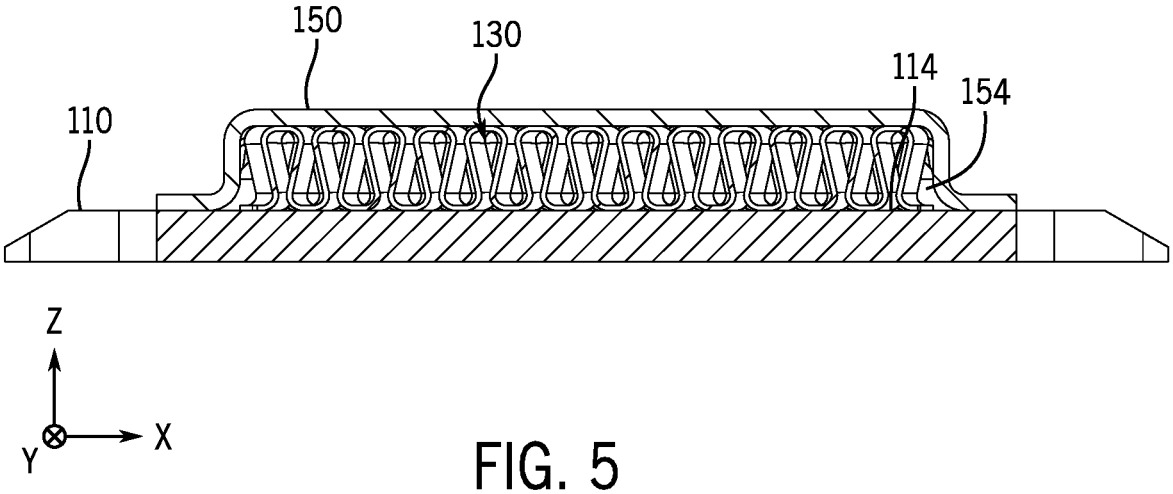
FIG. 5 is a front elevated cross-sectional view of the example heat exchanger assembly, taken along lines 5-5 as shown in FIG. 1 and looking in the direction of the arrows, showing the position of the fin insert between the bottom and top plates of the heat exchanger assembly.

FIG. 4 is a perspective cross-sectional view of heat exchanger 100, taken along lines 4-4 transversely through inlet 112 as shown in FIG. 1 and looking in the direction of the arrows. FIG. 4 illustrates inlet 112 and fin insert 130 positioned between bottom and top plates 110 and 150, respectively, of heat exchanger assembly 100. Specifically, FIG. 4 illustrates the coolant chamber that is formed in between bottom plate 110 and top plate 150, which is defined by inner surface 114 and inner surface 154. In some examples, bottom plate 110 and top plate 150 are sealedly joined together (e.g., by brazing, soldering, welding, adhesive, fasteners, etc.), such that the coolant chamber formed by inner surfaces 114 and 154 is fluid-tight. Fin insert 130 may likewise be soldered, brazed or welded at its top and bottom surfaces to the upper and lower plates, to which it is juxtaposed FIG. 5 depicts a front elevated cross-sectional view of heat exchanger 100, taken along lines 5-5 transversely approximately halfway between inlet 112 and outlet 118 as shown in FIG. 1 and looking in the direction of the arrows. FIG. 5 illustrates the position of fin insert 130 between bottom plate 110 and top plate 150, in which substantially flattened "upper" portions of fin insert 130 are shown direct contact with inner surface 154, and in which substantially flattened "lower" portions of fin insert 130 are likewise shown in direct contact with inner surface 114. As also shown in FIG. 5, the fins of fin insert 130 undulate in the x-direction (laterally or transverse to the direction of fluid flow), which increases the turbulence of coolant flowing between and through fin insert 130 to, in turn, effect a greater amount of cooling compared to non-undulating fin constructions.

Figure 6:
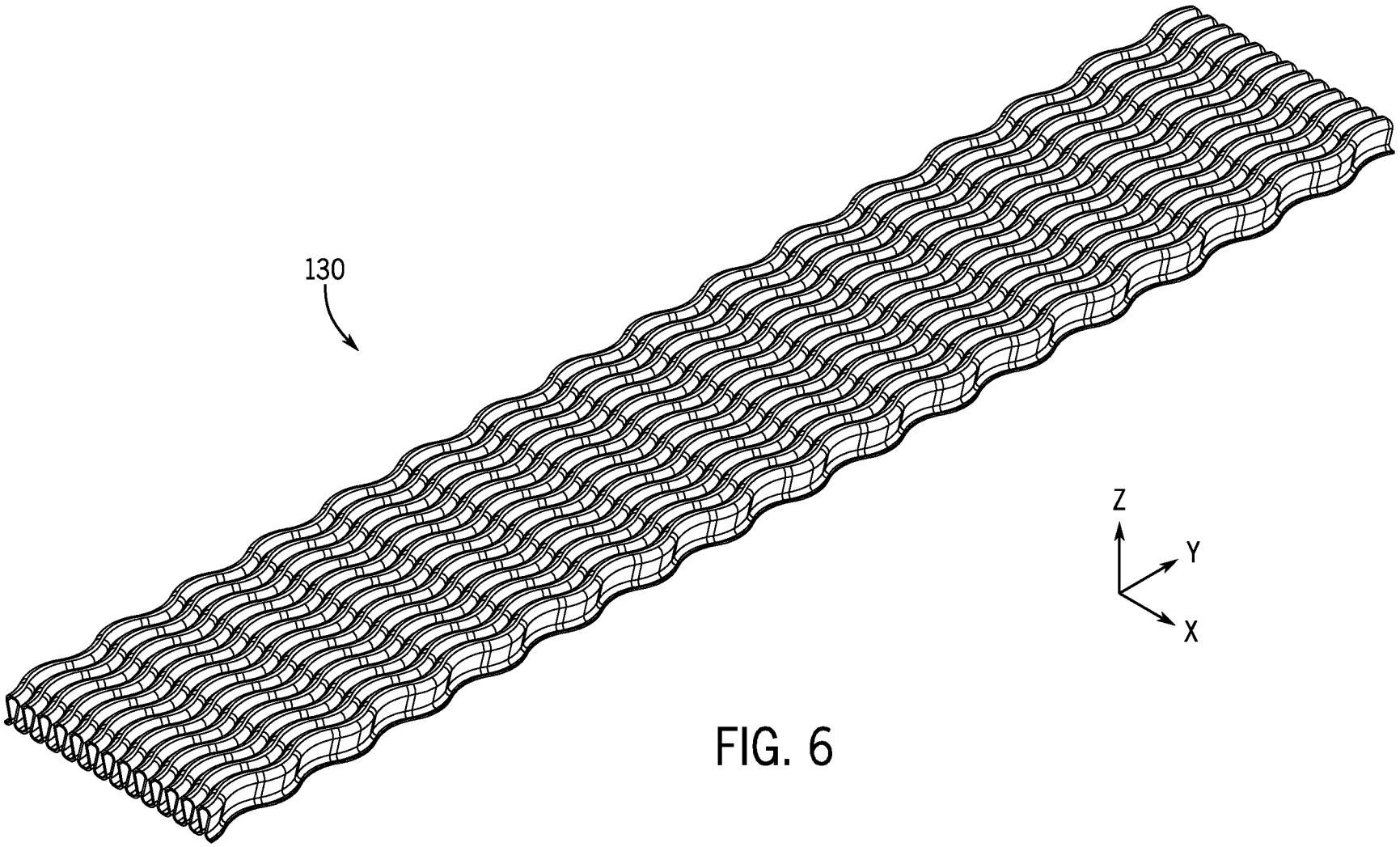
FIG. 6 is a perspective view showing the fin insert of the example heat exchanger assembly, showing the lateral undulations of the fin insert, according to the embodiment of FIG. 2.

FIG. 6 illustrates a perspective view showing fin insert 130 of heat exchanger 100, showing the lateral undulations of the fin insert that extend longitudinally (in the y-direction). Depending on the particular implementation, fin insert 130 may or may not necessarily include the depicted lateral undulations, or may have undulations of a different frequency or degree than shown in FIG. 6.

Figure 7A:
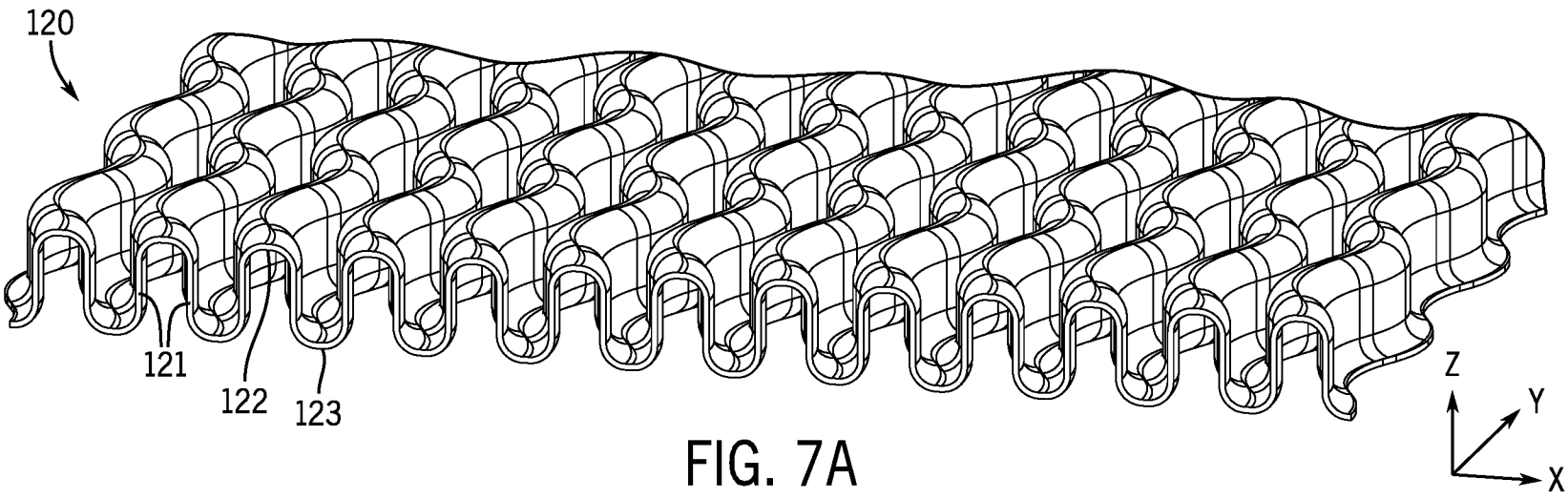
FIG. 7A is a detailed perspective view showing a partially-formed fin insert, before it is shaped into its final form shown in FIG. 7B.
Figure 7B:
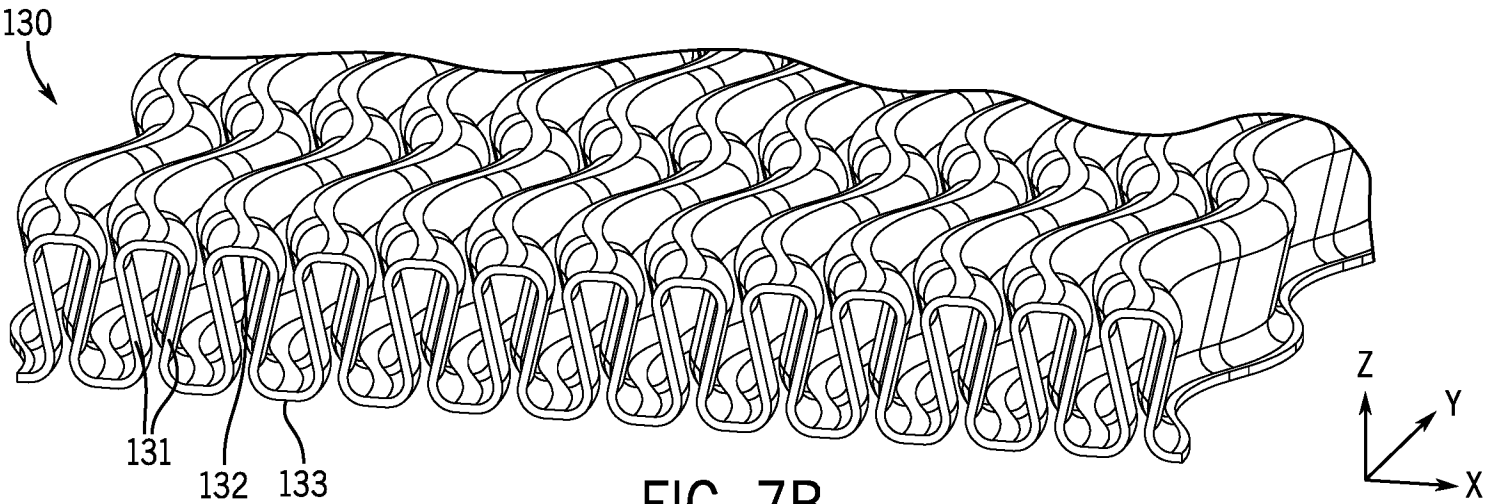
FIG. 7B is a detailed perspective view showing a fully-formed fin insert, according to the embodiment of FIG. 2.

FIGS. 7A and 7B show detailed perspective views of partially-formed fin insert 120 and fully-formed fin insert 130, respectively. A fin assembly may first be hydroformed (or otherwise constructed using other manufacturing techniques) into the shape shown in FIG. 7A, and subsequently formed into the shape shown in FIG. 7B, with or without the use of formation shims.

As shown in FIG. 7A, partially-formed fin insert 120 includes vertical sidewalls 121 that extend between upper arcs 122 and lower arcs 123. Sidewalls 121 are substantially vertical in the x-z plane. One minor advantage to having vertical fin sidewalls is that the distance for heat to travel along sidewalls 121 is minimal—such that the distance between, for example, upper arcs 122 and the midpoint of sidewalls 121 is relatively short. As a result, heat travelling through partially-formed fin insert 120 may be drawn away relatively quickly. However, a significant disadvantage to the fin construction of partially-formed fin insert 120 is that upper arcs 122 and lower arcs 123 are curved, and accordingly have a small "footprint" or shared contacting surface area with inner walls 154 and 114. As a result, the transfer of heat from bottom plate 110 and/or top plate 150 into partially-formed fin insert 120 may be undesirably inadequate—particularly for high-performance applications with stringent cooling requirements.

Fully-formed fin insert 130 of FIG. 7B overcomes these disadvantages, and provides substantial benefits over straight-fin constructions, by providing angled sidewalls 131 and wider, flattened upper walls 132 and lower walls 133. By angling sidewalls 131 at substantially congruent angles with respect to each other, the widths of upper walls 132 and lower walls 133 are increased relative to upper arcs 122 and 123. In addition, the substantially flattened upper walls 132 and lower walls 133 provide increased contact surface area with inner surfaces 154 and 114 of top plate 150 and bottom plate 110, respectively. Angled sidewalls 131 further serve to decrease the width of each fin of fin insert 130, enabling fin insert 130 to fit the same number of fins into a significantly narrower space (e.g., taking up less space in the x-direction). These advantages serve to improve the transfer of heat from bottom plate 110 and/or top plate 150 into fin insert 130, which itself has a larger surface area (compared to a straight fin insert of the same overall width) from which coolant flowing around and through fin insert 130 can extract heat and thereby cool an object.

Figure 8A:
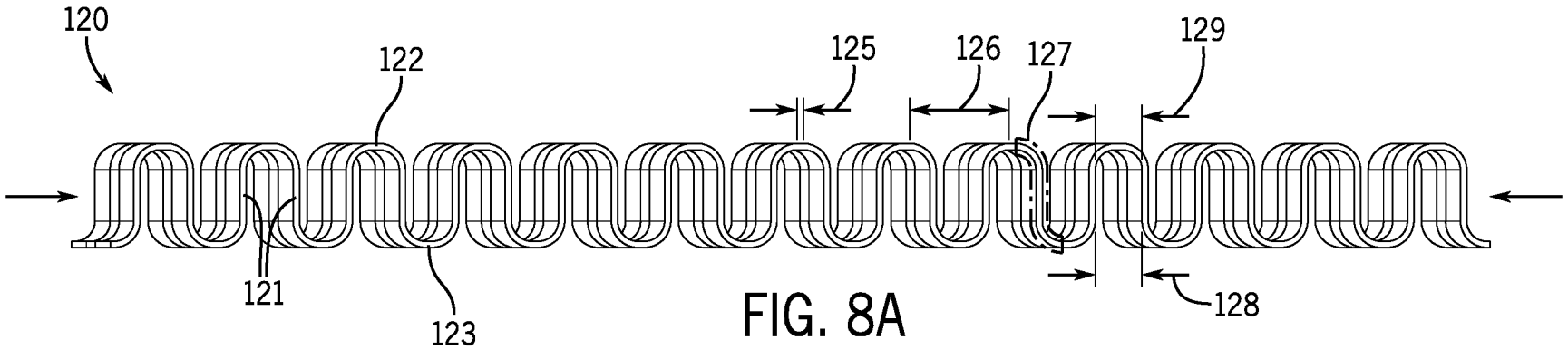
FIG. 8A is a front elevated view showing a partially-formed fin insert, before it is shaped into its final form shown in FIG. 8B.
Figure 8B:
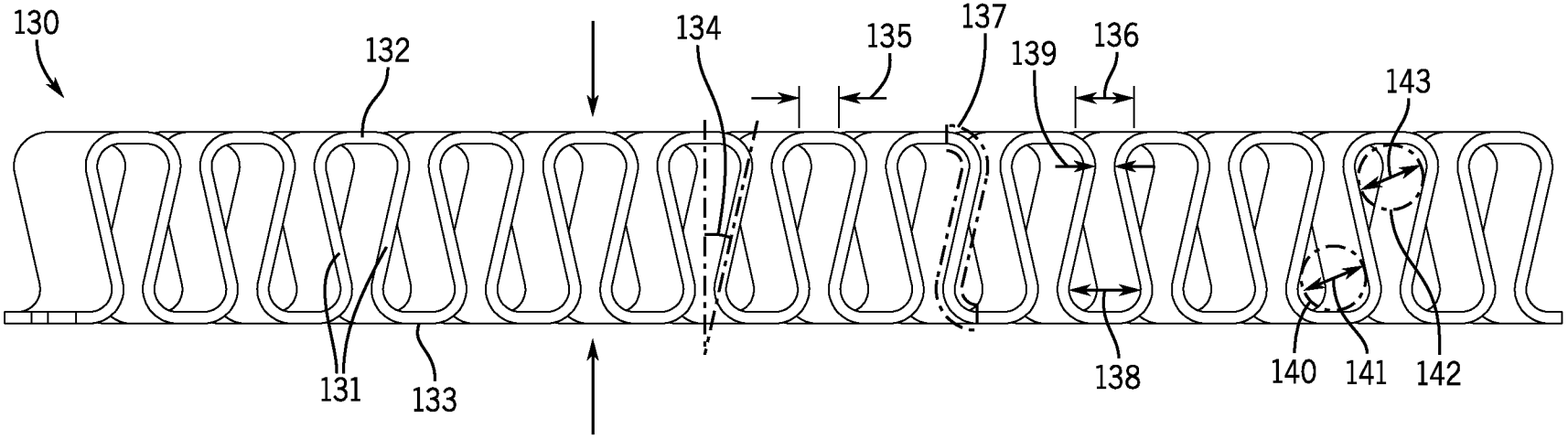
FIG. 8B is a front elevated view showing a fully-formed fin insert, showing its increased surface total surface area against the top and bottom plates of the example heat exchanger assembly, to thereby effect greater heat transfer compared to the partially-formed fin insert of FIG. 8A.

Similar to FIGS. 7A and 7B, FIGS. 8A and 8B show front elevated views of partially-formed fin insert 120 and fully-formed fin insert 130, respectively. FIGS. 8A and 8B illustrate various dimensional aspects of fin inserts 120 and 130 for the purposes of comparison.

Referring now to FIG. 8A, upper arcs 122 of partially-formed fin insert 120 each include a contacting portion 125, which represent the segments of upper arcs that would be in direct contact with inner surface 154 of top plate 150. Adjacent contacting portions 125 of upper arcs 122 are separated by distance 126. Likewise, as shown in FIG. 8B, upper walls 132 of fully-formed fin insert 130 each include a contacting portion 135, similarly representing the segments of the upper walls 132 that are in direct contact with inner surface 154 of top plate 150. Neighboring contacting portions 135 are separated by distance 136. By way of comparison, contacting portions 135 have a length that is substantially greater than contacting portions 125, thereby improving the transfer of heat at the interface between top plate 150 and fin insert 130. In addition, the utilization of surface area between top plate 150 and fin insert 130 (represented as the ratio between the length of contact portion 135 and distance 136) is significantly higher than the utilization of surface area between top plate 150 and partially-formed fin insert 120. Collectively, more "real estate" is being utilized in fin insert 130 to transfer heat from top plate 150 to insert 130, leading to more effective cooling in heat exchanger 100.

Referring again to FIG. 8A, segment 127 extends between contacting portion 125 and a corresponding contacting portion of lower arc 123. Similarly, as shown in FIG. 8B, segment 137 extends between contacting portion 135 and a corresponding contacting portion of lower wall 133. The length of segment 137 is slightly longer than the length of segment 127, which provides a greater amount of surface area in fin insert 130 compared to that of partially-formed fin insert 120.

As shown in FIG. 8A, partially-formed fin insert 120 includes gaps 128 extending between the lower ends of vertical sidewalls 121 near lower arcs 123, and gaps 129 spanning across upper arcs 122 at the point where upper arcs 122 meet vertical sidewalls 121. As sidewalls 121 are vertically oriented, gaps 128 and 129 are substantially the same size. In contrast, referring now to FIG. 8B, fin insert 130 includes gaps 138 spanning across lower wall 133 at the point where lower wall 133 meets angled sidewalls 131, and gaps 139 extending between upper ends of angled sidewalls 131 near upper walls 132. Gaps 138 are substantially larger than gaps 139, such that angled sidewalls 131 and lower walls 133 collectively form upside-down flattened omega shapes. Gaps 139 may be intentionally provided (rather than having angled sidewalls 131 completely converge) so as to prevent the generation of an unintentional blockage due to debris flowing within the coolant.

As shown in FIG. 8B, sidewalls 131 form angle 134 relative to the vertical axis (the z-axis). Angle 134 may be any suitable angle (e.g., between 10 degrees and 60 degrees, among other possible angles). The present disclosure contemplates that, to achieve a desired level of cooling, angle 134, the sizes of upper walls 132 and lower walls 133, the size of contacting portion 135 relative to the width of upper walls 132, and/or other aspects of fin insert 130 may be tuned or balanced as needed.

In addition, FIG. 8B conceptually illustrates shims 140 and 142, which may be positioned in and through the wider portions of the fins in fin insert 130. Shims 140 and 142 may have diameters 141 and 143, respectively, which serve to maintain the "omega" shape during the formation of fin insert 130. In an example manufacturing process, shims 140 and 142 may be positioned within the fins of partially-formed fin insert 120, in the manner shown in FIG. 8B. Then, an inward compressive force (shown as arrows at the ends of partially-formed fin insert 120 in FIG. 8A) may be applied, which compresses the fins into alternating omega and upside-down omega shapes, as shown in FIG. 8B. The now omega-shaped fin assembly may be compressed vertically (shown as arrows above and below fin insert 130 in FIG. 8B), which deforms the curved tops and bottoms of the fins into substantially flattened upper walls 132 and lower walls 133. Alternating compressive forces may be utilized to likewise form the undulations.

Although certain example methods and apparatus have been described herein, the scope of coverage of this patent is not limited thereto. On the contrary, this patent covers all methods, apparatuses, and articles of manufacture fairly falling within the scope of the appended claims, either literally or under the doctrine of equivalents.

It should be understood that arrangements described herein are for purposes of example only. As such, those skilled in the art will appreciate that other arrangements and other elements (e.g. machines, interfaces, operations, orders, and groupings of operations, etc.) can be used instead, and some elements may be omitted altogether according to the desired results. Further, many of the elements that are described are functional entities that may be implemented as discrete or distributed components or in conjunction with other components, in any suitable combination and location, or as other structural elements described as independent structures may be combined.

While various aspects and implementations have been disclosed herein, other aspects and implementations will be apparent to those skilled in the art. The various aspects and implementations disclosed herein are for purposes of illustration and are not intended to be limiting, with the true scope being indicated by the following claims, along with the full scope of equivalents to which such claims are entitled. It is also to be understood that the terminology used herein is for the purpose of describing particular implementations only, and is not intended to be limiting.

What is claimed is:

1. A heat exchanger for regulating the temperature of objects using a coolant, said heat exchanger comprising:

a bottom plate having a first end, a second end opposite the first end, an outer surface, and an inner surface opposite the outer surface, said bottom plate comprising a first coolant port proximate the first end and a second coolant port proximate the second end;

a top plate having a first end, a second end opposite the first end, an outer surface, and an inner surface opposite the outer surface, said top plate being sealedly engaged with the bottom plate for circulation of said coolant therethrough between said first and second coolant ports, in which the inner surface of said bottom plate and the inner surface of said top plate collectively defines a coolant chamber; and a substantially planar fin insert operably situated between said top and bottom plates within the coolant chamber, said fin insert having a first end positioned proximate the first coolant port and a second end positioned proximate the second coolant port, said fin insert comprising a plurality of fins extending longitudinally between the first and second ends of the fin insert, in which each fin includes:

a pair of angled sidewalls that converge at one end and diverge at an opposite end; and a substantially flat outer wall that extends across the pair of angled sidewalls at the end where said angled sidewalls diverge so as to form a substantially teardrop shape, wherein the substantially flat outer wall comprises a contacting portion that is in immediate contact with said inner surface of at least one of the top and bottom plate.

2. The heat exchanger according to claim 1, in which the plurality of fins laterally, collectively undulate between the first and second end of the fin insert.

3. The heat exchanger according to claim 1, in which the pair of angled sidewalls includes a first sidewall having a first angle, a second sidewall having a second angle, and wherein said first and second angles are equivalent.

4. The heat exchanger according to claim 1, in which said contacting portion has a first length, wherein a distance between adjacent contacting portions has a second length, and wherein the first length is substantially equal to the second length.

5. The heat exchanger according to claim 1, in which said contacting portion has a first length, wherein a distance between adjacent contacting portions has a second length, and wherein the first length is greater than the second length.

6. The heat exchanger according to claim 1, in which the pair of angled sidewalls at the converging end has a first gap extending therebetween of a first width, wherein the pair of angled sidewalls at the diverging end has a second gap extending therebetween of a second width, and wherein the second width is larger than the first width.

7. The heat exchanger according to claim 1, in which the pair of angled sidewalls at the converging end has a first gap extending therebetween of a first width, wherein the first width is greater than or equal to 1 millimeter to enable passage of debris within a coolant therebetween.

8. The heat exchanger according to claim 1, in which the substantially teardrop shape of said pair of angled sidewalls forms the shape of an omega.

* * * * *